United States Patent [19]

Cornell

[11] Patent Number: 4,898,551

[45] Date of Patent: Feb. 6, 1990

[54] CABLE CLAMP

[75] Inventor: Paul A. Cornell, Knockamore, Ireland

[73] Assignee: Pan Electric Corporation, Carson City, Nebr.

[21] Appl. No.: 336,106

[22] Filed: Apr. 11, 1989

[51] Int. Cl.[4] ..... H01R 4/40

[52] U.S. Cl. ..... 439/789

[58] Field of Search ..... 439/789, 803, 805, 812

[56] References Cited

U.S. PATENT DOCUMENTS

| | | | |
|---|---|---|---|
| D. 296,777 | 7/1988 | Cornell | D13/12 |
| 2,700,807 | 2/1955 | Petersen | 24/125 |
| 3,169,818 | 2/1965 | Tracy | 339/266 R |
| 3,406,372 | 10/1968 | Lawler | 439/789 |
| 3,437,979 | 4/1969 | Beaudion | 339/95 |
| 3,801,952 | 4/1974 | Lawlor | 339/266 R |
| 3,831,134 | 8/1974 | Cornell et al. | 339/266 R |
| 3,861,771 | 1/1975 | Cornell | 339/266 R |
| 3,879,104 | 4/1975 | Shugarman et al. | 339/266 R |
| 3,883,211 | 5/1975 | Shugarman et al. | 339/266 R |
| 3,973,821 | 8/1976 | Scott et al. | 339/266 R |
| 3,980,381 | 9/1976 | Cornell | 339/266 R |
| 4,001,921 | 1/1977 | Lawlor et al. | 339/266 R |
| 4,014,078 | 3/1977 | Cornell et al. | 339/266 R |
| 4,126,918 | 11/1978 | Cornell | 339/266 R |
| 4,128,294 | 12/1978 | McCord | 339/266 R |
| 4,357,068 | 11/1982 | Cornell et al. | 339/266 R |
| 4,479,694 | 10/1984 | Cornell et al. | 339/266 R |
| 4,548,462 | 10/1985 | Cornell | 339/266 R |

FOREIGN PATENT DOCUMENTS

| | | | |
|---|---|---|---|
| 1188953 | 4/1970 | United Kingdom | 439/789 |

*Primary Examiner*—P. Austin Bradley

*Attorney, Agent, or Firm*—Willian Brinks Olds Hofer Gilson & Lione

[57] ABSTRACT

A cable clamping device includes a female clamping member that includes a C-shaped head receiving portion and a tail. A male clamping member includes a cylindrical head positioned to rotate inside the head receiving portion of the female clamping member, and a radially extending tail. The free ends of the two tails define a total of four opposed surfaces, and these four opposed surfaces are parallel to one another when the two tails are clamped together. The lower side of the female clamping member defines a mounting plane, and the head receiving portion of the female clamping member extends both above and below the mounting plane. In this way, headroom requirements for the cable clamping device are reduced, and shorter fasteners can be used to secure the device in place.

22 Claims, 2 Drawing Sheets

CABLE CLAMP

BACKGROUND OF THE INVENTION

The present invention relates to an improved cable clamp which can be used to terminate a cable, for example to a bus bar.

The cable clamps shown in Cornell U.S. Pats. Nos. 4,357,068, 4,479,694, 4,458,462, and Des No. 296,277 (all assigned to the assignee of the present invention) have been found to provide excellent operational characteristics. They can be easily installed without special tools; they provide high cable pull-out resistance and low electric resistance; and the inner part of the clamp can be assembled into the outer part of the clamp in two separate orientations, each adapted to terminate a particular diameter cable.

However, the above-described cable clamps do exhibit certain disadvantages. In particular, when mounted to a mounting surface (such as a bus bar) they require an amount of headroom over the mounting surface which may be excessive for some applications. As electrical systems are made smaller, it becomes increasingly important to minimize the headroom required for cable clamps. Furthermore, because the free ends of the two parts of the clamping device have a substantial thickness, a relatively long fastener or stud is required to secure the cable clamp in place on the mounting surface.

Accordingly, it is an object of this invention to provide an improved cable clamping device which reduces the amount of headroom required for the clamping device, which reduces the thickness of the free ends of the parts of the clamping device, and which therefore reduces the length of the fastener required to secure the clamping device in place.

SUMMARY OF THE INVENTION

According to a first aspect of this invention, a cable clamp (which may be of the general type shown in the Cornell patents identified above) includes male and female clamping members, and a head receiving portion of the female clamping member extends partly beneath the mounting plane defined by a tail of the female clamping member. Because the head receiving portion of the female clamping member extends in part below the mounting plane, the overall headroom required to mount the female clamping member (and therefore the cable clamp itself) is reduced.

According to another feature of this invention, a cable clamp which may be of the general type shown in the Cornell patents includes first and second tails, defined by male and female clamping members, respectively. Each of these tails defines a pair of opposed surfaces at its free end, and all four of these surfaces are parallel to one another when the tails are clamped together. This arrangement allows the thickness of the two tails to be reduced, and therefore the length of the fastening member to be minimized.

The following detailed description will bring out important advantages of this invention. Here, it is enough to note that the preferred embodiments of this invention exhibit reduced headroom requirements, reduced tail thickness, reduced fastener length, reduced metal content, and reduced manufacturing costs as compared to the cable clamps shown in the above-identified Cornell patents.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
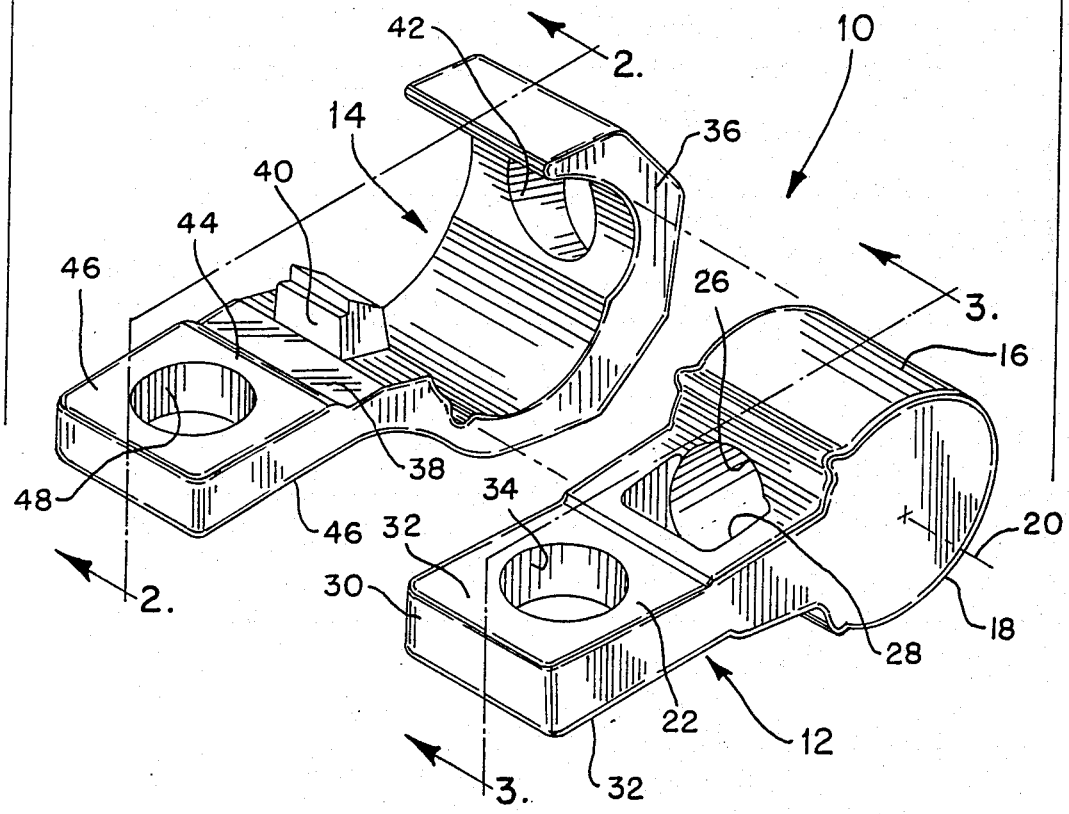
FIG. 1 is a perspective view of a presently preferred embodiment of the cable clamp of this invention.
Figure 3A:
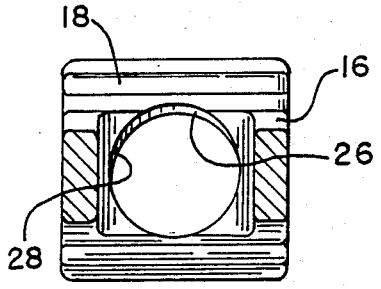
FIG. 3A is a sectional view taken along line 3A—3A of FIG. 3.

Turning now to the drawings, FIG. 1 shows a perspective view of a cable clamp 10 which incorporates a presently preferred embodiment of this invention. As shown in FIG. 1, the cable clamp 10 includes a male clamping member 12 and a female clamping member 14. The male clamping member 12 is shown in greater detail in FIGS. 3 and 3A, and it includes a cylindrical head portion 16 which defines a cylindrical surface 18 centered on a cylinder axis 20 (FIG. 1). A first tail 22 extends radially away from the cylindrical head portion 16, and the male clamping member 12 is symmetrical about a plane of symmetry 24 (FIG. 3) which contains the cylinder axis 20.

Figure 3:
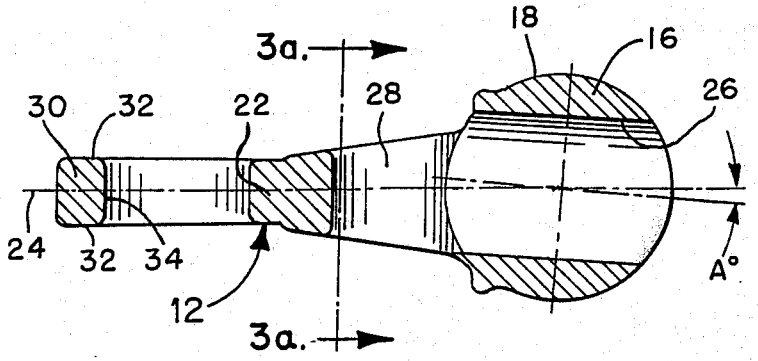
FIG. 3 is a sectional view taken along line 3—3 of FIG. 1.

The male clamping member 12 includes a first cable receiving opening 26 that, as shown in FIG. 3, is oriented at a skew angle with respect to the first tail 22 and the plane of symmetry 24. In FIG. 3 this skew angle is indicated as equal to A°. The first cable receiving opening 26 is adapted to receive the terminal portion of a cable, and the opening 26 opens out at both sides of the first tail 22 at a window 28 which passes completely through the first tail 22.

The first tail 22 defines a free end 30 and a pair of spaced, parallel, opposed first surfaces 32 adjacent to the free end 30. Both of these first surfaces 32 are parallel to the plane of symmetry 24. A fastener receiving opening 34 extends completely through the first tail 22 and receives a mounting fastener as described below.

Figure 2A:
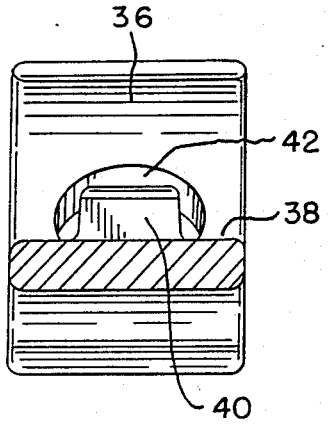
FIG. 2A is a sectional view taken along line 2A—2A of FIG. 2.
Figure 2:
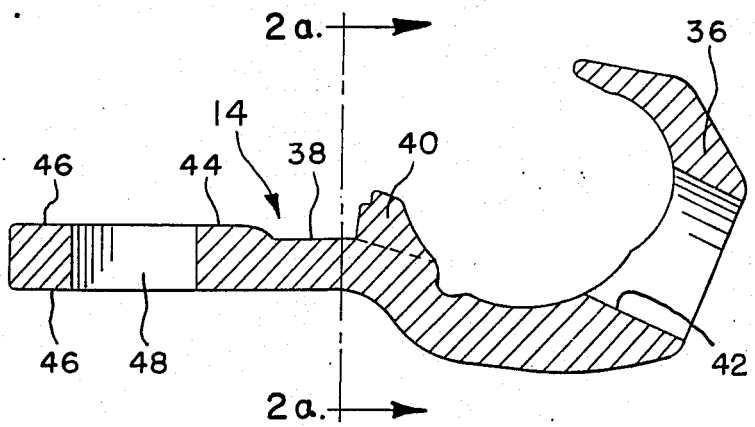
FIG. 2 is a sectional view taken along line 2—2 of FIG. 1.

FIGS. 1, 2 and 2A provide a detailed illustration of the female clamping member 14. The female clamping member 14 includes a head receiving portion 36 which is generally C-shaped and is sized to receive the cylindrical head portion 16 for rotation about the cylinder axis 20. The head receiving portion 36 is integrally connected with a second tail 38 that defines a protruding element 40 positioned to extend into the window 28 when the first and second tails 22, 38 are clamped together.

A second cable receiving opening 42 extends through the head receiving portion 36 and is positioned to align with the opening 26 when the male clamping member 12 is placed in an open position, in which the first and second tails 22, 38 are separated from one another. The second tail 38 defines a free end 44 and two opposed parallel second surfaces 46 adjacent to the free end 44. A fastener receiving opening 48 passes through the free end 44 of the second tail 38 and is aligned with the opening 34 when the first and second tails 22, 38 are clamped together.

Figure 4:
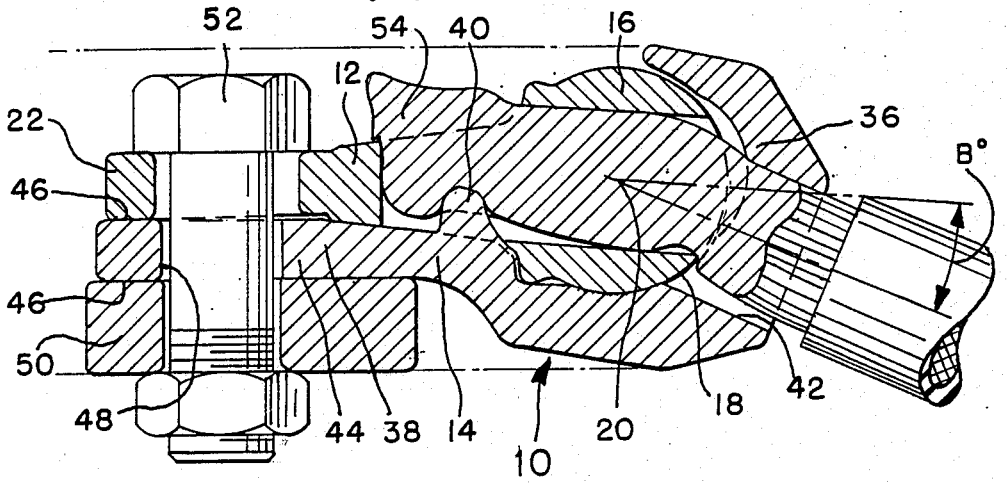
FIG. 4 is a sectional view of the embodiment of FIG. 1 mounted in place to a bus bar, with the clamping device configured to clamp a relatively larger cable.
Figure 5:
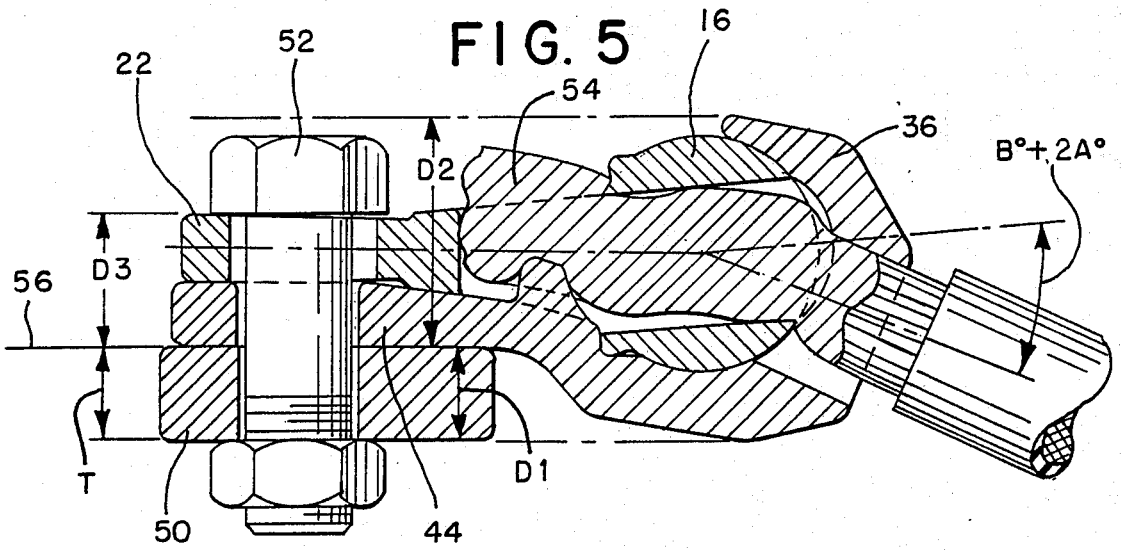
FIG. 5 is a view corresponding to that of FIG. 4 with the clamping device configured to clamp a relatively smaller cable.

The lower one of the second surfaces 46 acts as a mounting surface and is configured to be positioned against a support element such as a bus bar 50, as shown in FIGS. 4 and 5. The upper one of the second surfaces 46 is positioned to abut the adjacent one of the first surfaces 32 of the male clamping member 12.

FIGS. 4 and 5 show the manner in which the cable clamp 10 can be secured to a support element such as a bus bar 50 by a fastener 52. The fastener 52 clamps the first and second tails 22, 38 together and secures the entire clamp 10 in position on the bus bar 50.

In use, the fastener 52 is initially removed and the male clamping member 12 is rotated to an open position (not shown) in which the first and second tails 22, 38 are spaced from one another. Then the terminal portion 54 of a cable is inserted through the cable receiving openings 26, 42 until it abuts against the extreme end of the window 28. Then the male clamping element 12 is rotated toward the clamping position shown in FIGS. 4 and 5, and the fastener 52 is used to clamp the first and second tails 22, 38 together. This causes the protruding element 40 to move into the window 28 and the cable to be clamped at four clamping points as shown by the arrows in FIG. 4.

As shown in FIGS. 4 and 5 the male and female clamping elements 12, 14 can be assembled in two different orientations to clamp cables of two different diameters. In FIG. 4 the male clamping element 12 is in a first orientation in which the angle B separates the open and closed positions. In FIG. 5 the male clamping element 12 has been rotated by 180° about an axis of symmetry that is contained in the plane of symmetry 24 and is perpendicular to the cylinder axis 20. Because of the skew angle A shown in FIG. 3, in this alternate position the angular separation between the open and closed positions of the male clamping member 12 is B +2A, and thus the cable clamp 12 when assembled as shown in FIG. 5 operates to clamp a smaller cable. In this regard, the cable clamp 10 functions quite similarly to the cable clamp described in detail in the above-identified Cornell patents.

Several important features of the cable clamp 10 contribute to its particularly low over head requirements. In particular, the lower one of the second surfaces 46 defines a mounting plane 56 which is positioned on the bus bar 50 when the cable clamp 10 is mounted in place as shown in FIGS. 4 and 5. However, in contrast with the prior art designs described above, the mounting plane 56 extends only over a portion of the lower side of the female clamping member 14, and the head receiving portion 36 of the female clamping member 14 extends below the mounting plane 56.

In FIG. 4 the reference symbol D1 designates a first distance equal to the distance the female clamping member 14 extends below the mounting plane 56. The reference symbol D2 designates a second distance equal to the distance by which the female clamping member 14 extends above the mounting plane 56. As shown in FIG. 4, in this embodiment D1 is approximately equal to two-fifths of D2. In general, D1 should be no greater than D2. In many applications, it is preferred that D1 be no greater than one-half of D2. Because a portion of the female clamping member 14 extends below the mounting plane 56, the headroom requirement of the cable clamp 10 (D2) is substantially reduced as compared to prior art designs.

In FIG. 4 the reference symbol T is used to designate the characteristic thickness of the bus bar 50. Preferably, D1 is no greater than T so that the cable clamp 10 does not extend below the bus bar 50. This insures that the cable clamp 10 will not interfere with any devices mounted below the bus bar 50.

In FIG. 4 the combined thicknesses of the two tails 22, 38 is designated by the reference symbol D3. Preferably, D1 is no greater than D3.

The foregoing detailed description illustrates a number of significant advantages of this preferred embodiment. It should be noted that the first surfaces 32 are parallel to one another and to the plane of symmetry 24, that the second surfaces 46 are parallel to one another, and that the first and second surfaces 32, 46 are parallel to one another when the tails 22, 38 are clamped together. This arrangement has been found to minimize the overall thickness D3 of the two tails 22, 38 when they are clamped together, while permitting the male clamping member 12 to be used in the two different orientations shown in FIGS. 4 and 5. This reduces the length of the fastener 52 as well as the mass of metal required to form the male and female clamping members 12, 14.

Furthermore, because the female clamping member 14 extends partly below the mounting plane 56 while remaining mostly above the mounting plane 56, the over head requirement for the cable clamp 10 is minimized, without creating obstructions beneath the bus bar 50.

Simply by way of example, the clamping members 12, 14 are preferably machined from extruded bar stock. The bar stock is preferably an aluminum than 46% of the International Annealed Copper Standard and a tensile strength of approximately 300 MPa. Aluminum alloy 6082 T6 International Standard has been found suitable. The cable receiving openings should preferably be sized approximately 110% of the largest cable to be clamped, and external corners can be radiused if desired to reduce corona discharge.

Of course, it should be understood that this invention is not limited to use in cable clamps of the types shown in the above-identified Cornell patents, and that it can be adapted to other types of cable clamping devices. It is therefore intended that the foregoing detailed description be regarded as illustrative rather than limiting, and that it be understood that it is the following claims, including all equivalents, which are intended to define the scope of this invention.

I claim:

1. A cable clamp for terminating a cable, said connector comprising:

a male member having a generally cylindrical head and a first tail extending away from the head, said head defining a first cable receiving opening extending out of a cylindrical surface of the head, said first tail having two opposed first surfaces adjacent to a free end thereof;

a female member having a head receiving portion and a second tail, said head receiving portion receiving the head and shaped to permit rotation of the head, said head receiving portion defining a second cable receiving opening positioned to align with the first cable receiving opening when the male member is rotated to an open position with respect to the female member, said second tail having two opposed second surfaces at a free end thereof, one of said second surfaces acting as a mounting surface for the female member, the other of the second surfaces positioned to abut the adjacent one of the first surfaces;

said mounting surface defining a mounting plane, at least the majority of the male member situated above the mounting plane, a portion of the head receiving portion situated below the mounting plane to reduce the height of the female member above the mounting plane, said head receiving portion extending above the mounting plane by a distance greater than that by which it extends below the mounting plane;

said first and second surfaces defining aligned apertures therethrough to receive a mounting fastener that clamps the first tail adjacent to the second ail and secures the mounting surface of the second tail against a support element.

2. The invention of claim 1 wherein the first cable receiving opening is oriented at a skew angle with respect to the first tail, and wherein the female member receives the male member positioned in both of two orientations of the male member.

3. The invention of claim 1 wherein a portion of the cylindrical head of the male member extends below the mounting plane.

4. The invention of claim 1 wherein the head receiving portion extends below the mounting plane by a first distance and above the mounting plane by a second distance, and wherein the first distance is no more than one half the second distance.

5. The invention of claim 1 wherein the first and second tails define a selected thickness when clamped together, and wherein the head receiving portion extends below the mounting plane by a distance substantially no greater than said selected thickness.

6. The invention of claim 1 wherein the male and female members are secured to a mounting plate by a mounting fastener which passes through the aligned apertures, wherein the mounting plate defines a thickness, and wherein the head receiving portion extends below the mounting plane by a distance substantially no greater than said thickness.

7. The invention of claim 1 wherein the first surfaces are parallel to one another and wherein the second surfaces are parallel to one another.

8. The invention of claim 7 wherein the first cable receiving opening extends into a window in the first tail, and wherein the second tail defines a protruding element positioned to extend into the window when the first tail is clamped against the second tail.

9. The invention of claim 7 wherein the cylindrical head of the male member defines a cylinder axis, wherein the male member defines a plane of symmetry containing the cylinder axis, and wherein the two first surfaces are parallel to the plane of symmetry and to the mounting plane when the first and second tails are clamped together.

10. The invention of claim 9 wherein the female member receives the male member in two separate orientations, one rotated by 180° with respect to the other about a symmetry axis in the plane of symmetry and transverse to the cylinder axis.

11. The invention of claim 10 wherein the first cable receiving opening is oriented at a skew angle with respect to the plane of symmetry.

12. A cable clamp for terminating a cable, said connector comprising:

a male member comprising a substantially cylindrical head which defines a cylinder axis and a first tail which extends radially away from the head such that the male member is symmetrical about a plane of symmetry that passes through the first tail and the head and contains the cylinder axis; said male member defining a first cable receiving opening that passes through the cylindrical head into the first tail and opens out at both sides of the tail at a window, said first cable receiving opening oriented at a skew angle with respect to said plane of symmetry, said first tail having a free end which defines a pair of opposed first surfaces;

a female member comprising a C-shaped receiving portion which receives the head for rotation about the cylinder axis and a second tail that defines a pair of opposed second surfaces, said C-shaped portion defining a second cable receiving opening positioned to align with the first cable receiving opening when the male member is rotated to an open position, said second tail defining a protruding element positioned to extend into the window when the male member is rotated to a closed position;

a lower one of said second surfaces defining a mounting plane and an upper one of said second surfaces positioned to contact one of the first surfaces of said first tail;

said C-shaped portion of said female member configured to extend below the mounting plane, said female member defining a first distance by which the female member extends below the mounting plane and a second distance by which the female member extends above the mounting plane, said first distance being substantially no more than one half said second distance.

13. The invention of claim 12 wherein said first surfaces are parallel to each other and to said plane of symmetry.

14. The invention of claim 13 wherein said second surfaces are parallel to each other.

15. The invention of claim 13 wherein said first distance is no greater than the combined thickness of the first and second tails.

16. The invention of claim 13 wherein the male and female members are mounted to a mounting element, wherein the mounting element contacts the lower one of said second surfaces at the mounting plane, wherein the mounting element defines a characteristic thickness, and wherein the first distance is substantially no greater than said characteristic thickness.

17. A cable clamp for terminating a cable, said connector comprising:

a male member comprising a substantially cylindrical head which defines a cylinder axis and a first tail which extends radially away from the head such that the male member is symmetrical about a plane of symmetry that passes through the first tail and the head and contains the cylinder axis; said male member defining a first cable receiving opening that passes through the cylindrical head into the first tail and opens out at both sides of the tail at a window, said first cable receiving opening oriented at a skew angle with respect to said plane of symmetry, said first tail having a free end which defines a pair of opposed first surfaces;

a female member comprising a C-shaped receiving portion which receives the head for rotation about the cylinder axis and a second tail that defines a pair of opposed second surfaces, said C-shaped portion defining a second cable receiving opening positioned to align with the first cable receiving opening when the male member is rotated to an open position, said second tail defining a protruding element positioned to extend into the window when the male member is rotated to a closed position;

a lower one of said second surfaces defining a mounting plane and an upper one of said second surfaces positioned to contact one of the first surfaces of said first tail;

said female member configured to extend below the mounting plane, said female member defining a first distance by which the female member extends below the mounting plane and a second distance by which the female member extends above the mounting plane, said first distance being substantially no more than the combined thickness of the first and second tails.

18. The invention of claim 17 wherein said first surfaces are parallel to each other and to said plane of symmetry.

19. The invention of claim 18 wherein said second surfaces are parallel to each other.

20. The invention of claim 18 wherein the male and female members are mounted to a mounting element, wherein the mounting element contacts the lower one of said second surfaces at the mounting plane, wherein the mounting element defines a characteristic thickness, and wherein the first distance is substantially no greater than said characteristic thickness.

21. The invention of claim 20 wherein said first distance is substantially no more than one half said second distance.

22. A cable clamp for terminating a cable, said connector comprising:

a male member comprising a substantially cylindrical head which defines a cylinder axis and a first tail which extends radially away from the head such that the male member is symmetrical about a plane of symmetry that passes through the first tail and the head and contains the cylinder axis; said male member defining a first cable receiving opening that passes through the cylindrical head into the first tail and opens out at both sides of the tail at a window, said first cable receiving opening oriented at a skew angle with respect to said plane of symmetry, said first tail having a free end which defines a pair of opposed first surfaces;

a female member comprising a C-shaped receiving portion which receives the head for rotation about the cylinder axis and a second tail that defines a pair of opposed second surfaces, said C-shaped portion defining a second cable receiving opening positioned to align with the first cable receiving opening when the male member is rotated to an open position, said second tail defining a protruding element positioned to extend into the window when the male member is rotated to a closed position;

a lower one of said second surfaces defining a mounting plane and an upper one of said second surfaces positioned to contact one of the first surfaces of said first tail;

said plane of symmetry, said first surfaces and said second surfaces all being parallel to one another when the first and second tails are clamped together.

* * * * *

UNITED STATES PATENT AND TRADEMARK OFFICE

CERTIFICATE OF CORRECTION

PATENT NO. : 4,898,551

DATED : February 6, 1990

INVENTOR(S) : Paul A. Cornell

It is certified that error appears in the above-identified patent and that said Letters Patent is hereby corrected as shown below:

In column 4, line 37, after "aluminum" insert --alloy having an electrical conductivity of not less--

Signed and Sealed this

Twenty-sixth Day of May, 1992

*Attest:*

DOUGLAS B. COMER

*Attesting Officer*

*Acting Commissioner of Patents and Trademarks*